US010381776B2

(12) United States Patent
Wu et al.

(10) Patent No.: US 10,381,776 B2
(45) Date of Patent: Aug. 13, 2019

(54) CONNECTOR ASSEMBLY WITH AN IMPROVED LATCH MEMBER HAVING A SHORTER LENGTH

(71) Applicant: FOXCONN INTERCONNECT TECHNOLOGY LIMITED, Grand Cayman (KY)

(72) Inventors: Jerry Wu, New Taipei, CA (US); Jun Chen, Kunshan (CN); Xiao Fan, Kunshan (CN); Zhao-Tao Jiang, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/944,795

(22) Filed: Apr. 4, 2018

(65) Prior Publication Data

US 2018/0294602 A1 Oct. 11, 2018

(30) Foreign Application Priority Data

Apr. 6, 2017 (CN) ..... 2017 2 0352180 U

(51) Int. Cl.

| | |
|---|---|
| ***H01R 12/53*** | (2011.01) |
| ***H01R 12/57*** | (2011.01) |
| ***H01R 12/72*** | (2011.01) |
| ***H01R 13/66*** | (2006.01) |
| ***H01R 31/06*** | (2006.01) |
| ***H01R 13/506*** | (2006.01) |

(Continued)

(52) U.S. Cl.

CPC ..... *H01R 13/6273* (2013.01); *H01R 12/53* (2013.01); *H01R 12/57* (2013.01);

(Continued)

(58) Field of Classification Search

CPC ..... H01R 13/506; H01R 13/6273; H01R 13/6275; H01R 13/635; H01R 13/665; H01R 12/71; H01R 31/06

(Continued)

(56) References Cited

U.S. PATENT DOCUMENTS 6,319,040 B1 * 11/2001 Chang ..... H01R 13/6275 439/352
6,435,409 B1 * 8/2002 Hu ..... H05K 5/0278 235/441

(Continued)

FOREIGN PATENT DOCUMENTS

CN 201323347 Y 10/2009
CN 203850559 U 9/2014

*Primary Examiner* — Edwin A. Leon
*Assistant Examiner* — Oscar C Jimenez
(74) *Attorney, Agent, or Firm* — Wei Te Chung; Ming Chieh Chang

(57) ABSTRACT

A connector assembly includes: an insulative housing defining a receiving room communicating with the outside; and a latch member assembled in the receiving room of the insulative housing, the latch member comprising a fixing portion fixed on the insulative housing, a latch arm extending along a first direction and movably received in the receiving room, and a latch portion defined on a front end of the latch arm and exposed to the outside through the receiving room for cooperating with the docking connector; wherein a first bent portion is bent and formed on a rear end of the latch arm and extends along a second direction angled relative to the first direction, and the first bent portion is connected between the latch arm and the fixing portion and driven by the latch arm to move when the latch arm is operated.

5 Claims, 8 Drawing Sheets

(51) Int. Cl.
*H01R 13/627* (2006.01)
*H01R 13/635* (2006.01)
*H01R 13/6583* (2011.01)

(52) U.S. Cl.
CPC ..... *H01R 13/6275* (2013.01); *H01R 13/635* (2013.01); *H01R 13/6583* (2013.01); *H01R 13/665* (2013.01); *H01R 12/721* (2013.01); *H01R 13/506* (2013.01); *H01R 31/06* (2013.01)

(58) Field of Classification Search
USPC ..... 439/352, 357, 358, 362, 638
See application file for complete search history.

(56) References Cited

U.S. PATENT DOCUMENTS 6,558,183 B1 * 5/2003 Ji ..... H01R 13/6275 439/358
2004/0235354 A1 * 11/2004 Takahashi ..... H01R 13/639 439/630
2006/0086792 A1 * 4/2006 Chen ..... G06K 7/0013 235/441
2008/0032560 A1 * 2/2008 Shi ..... H01R 13/506 439/638
2009/0113093 A1 * 4/2009 Chen ..... H01R 13/7175 710/74
2011/0003496 A1 * 1/2011 Hu ..... G06K 7/0021 439/159
2012/0034819 A1 * 2/2012 Chen ..... H01R 31/065 439/638
2015/0288104 A1 10/2015 Molex
2015/0333460 A1 11/2015 Molex
2015/0364865 A1 11/2015 Molex
2016/0315418 A1 10/2016 Sutter et al.
2017/0070006 A1 3/2017 Molex
2018/0323544 A1 * 11/2018 Wu ..... H01R 13/6275

* cited by examiner

CONNECTOR ASSEMBLY WITH AN IMPROVED LATCH MEMBER HAVING A SHORTER LENGTH

BACKGROUND OF THE INVENTION

1. Field of the Invention

The present invention relates to a connector assembly, and more particularly to a connector assembly with an improved latch member conducive to the miniaturization of the connector.

2. Description of the Related Art

Chain Patent No. 201323347, issued on Oct. 7, 2009, discloses an electrical connector including an insulative housing, a plurality of contacts retrained in the insulative housing, a shielding case enclosing the insulative housing, a latch member received in the insulative housing, and an outer case enclosing the insulative housing and the shielding case. As the electrical connector becomes shorter and the internal structure becomes more complex, the size of the latch member is limited. If the size of the latch member is too small, it is difficult to meet the elasticity requirements for latch member.

Therefore, it is desired to have a connector assembly with an improved latch member to meet the space limitation and satisfying the requirement of the elastic latch of the electrical connector.

BRIEF SUMMARY OF THE INVENTION

An object of the present invention is to provide a connector assembly with an improved latch member having a shorter length.

In order to achieve above-mentioned object, a connector assembly for mating with a docking connector comprises: an insulative housing defining a receiving room communicating with the outside; and a latch member assembled in the receiving room of the insulative housing, the latch member comprising a fixing portion fixed on the insulative housing, a latch arm extending along a first direction and movably received in the receiving room, and a latch portion defined on a front end of the latch arm and exposed to the outside through the receiving room for cooperating with the docking connector; wherein a first bent portion is bent and formed on a rear end of the latch arm and extends along a second direction angled relative to the first direction, and the first bent portion is connected between the latch arm and the fixing portion and driven by the latch arm to move when the latch arm is operated.

Other objects, advantages and novel features of the invention will become more apparent from the following detailed description of the present embodiment when taken in conjunction with the accompanying drawings.

DESCRIPTION OF PREFERRED EMBODIMENT OF THE INVENTION

Figure 1:
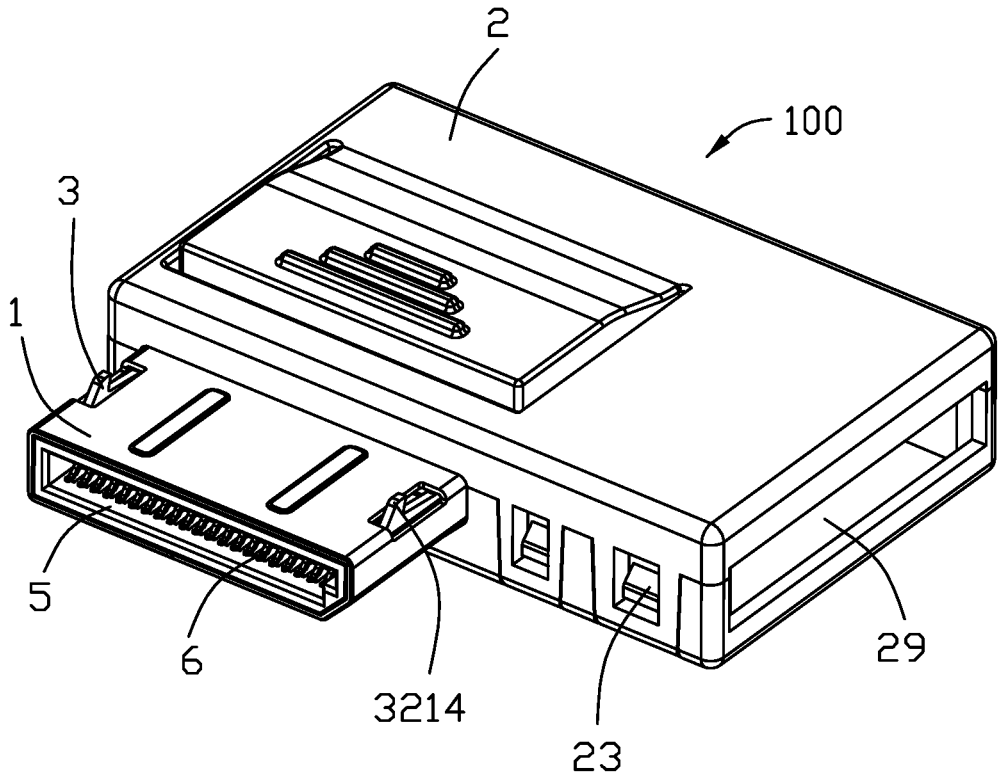
FIG. 1 is a perspective view showing a connector assembly in accordance with a prefer embodiment of the present invention.
Figure 2:
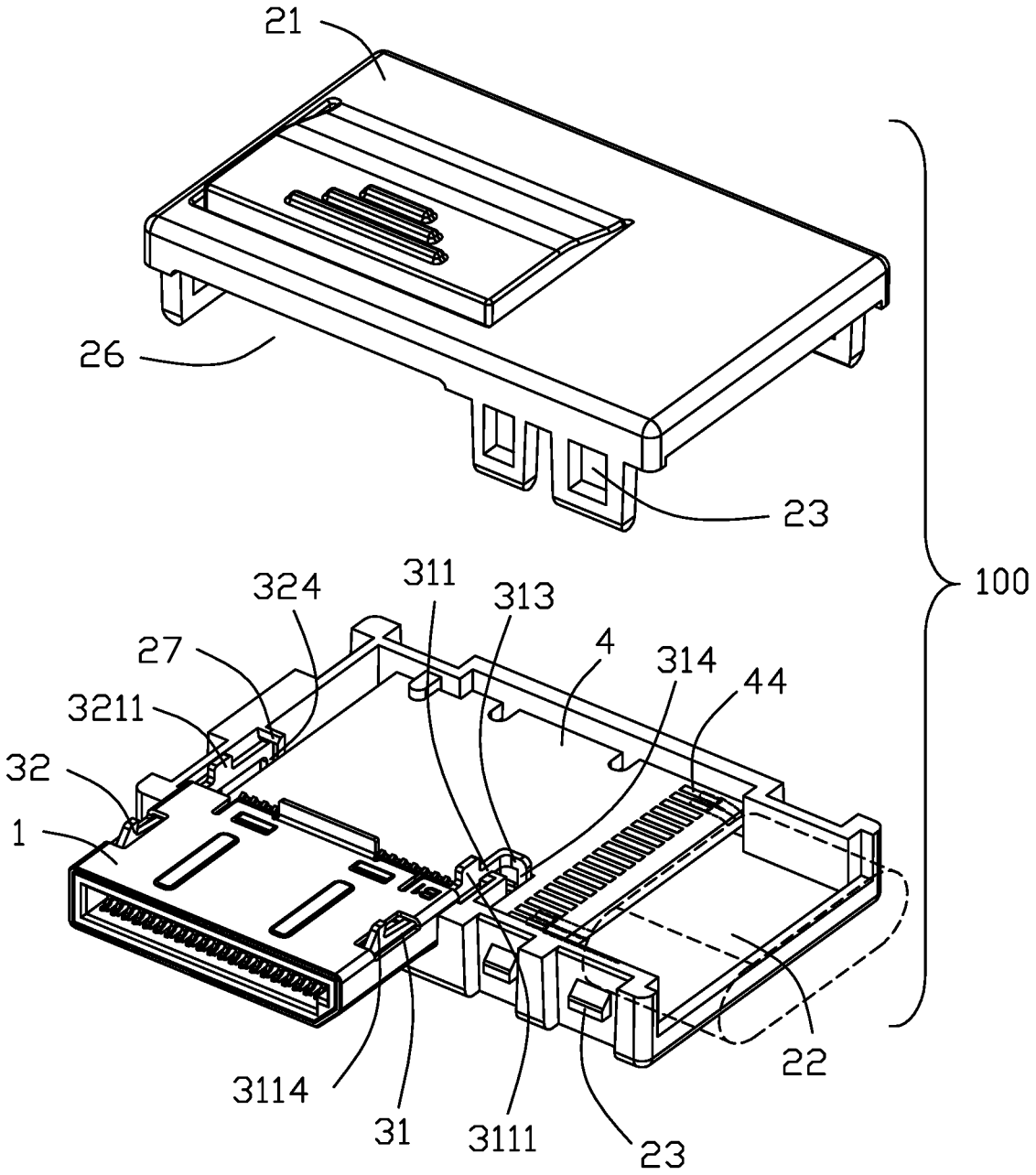
FIG. 2 is a partially exploded view showing the connector assembly shown in FIG. 1.
Figure 3:
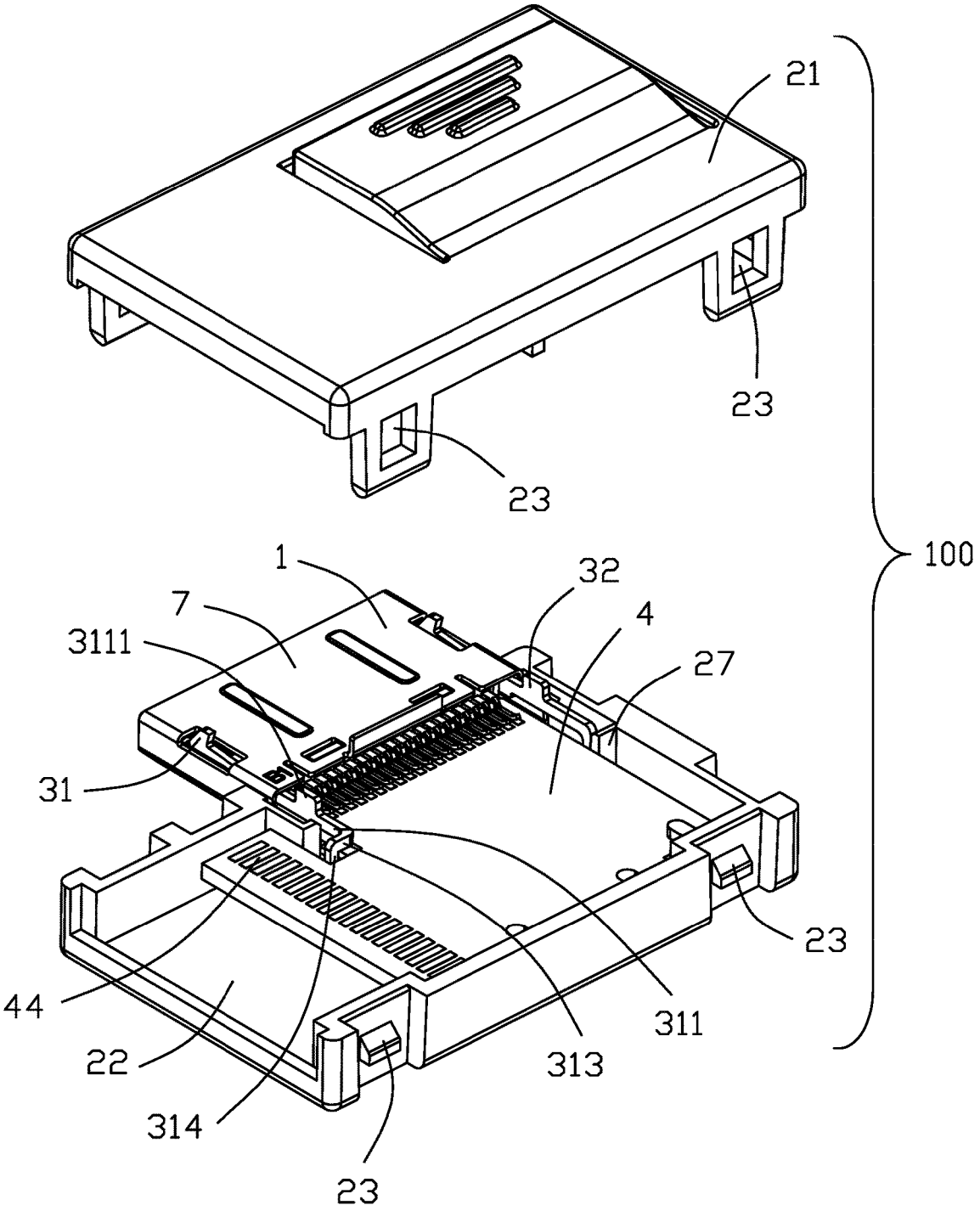
FIG. 3 is a partially exploded view similar to FIG. 2, but from a different perspective.
Figure 4:
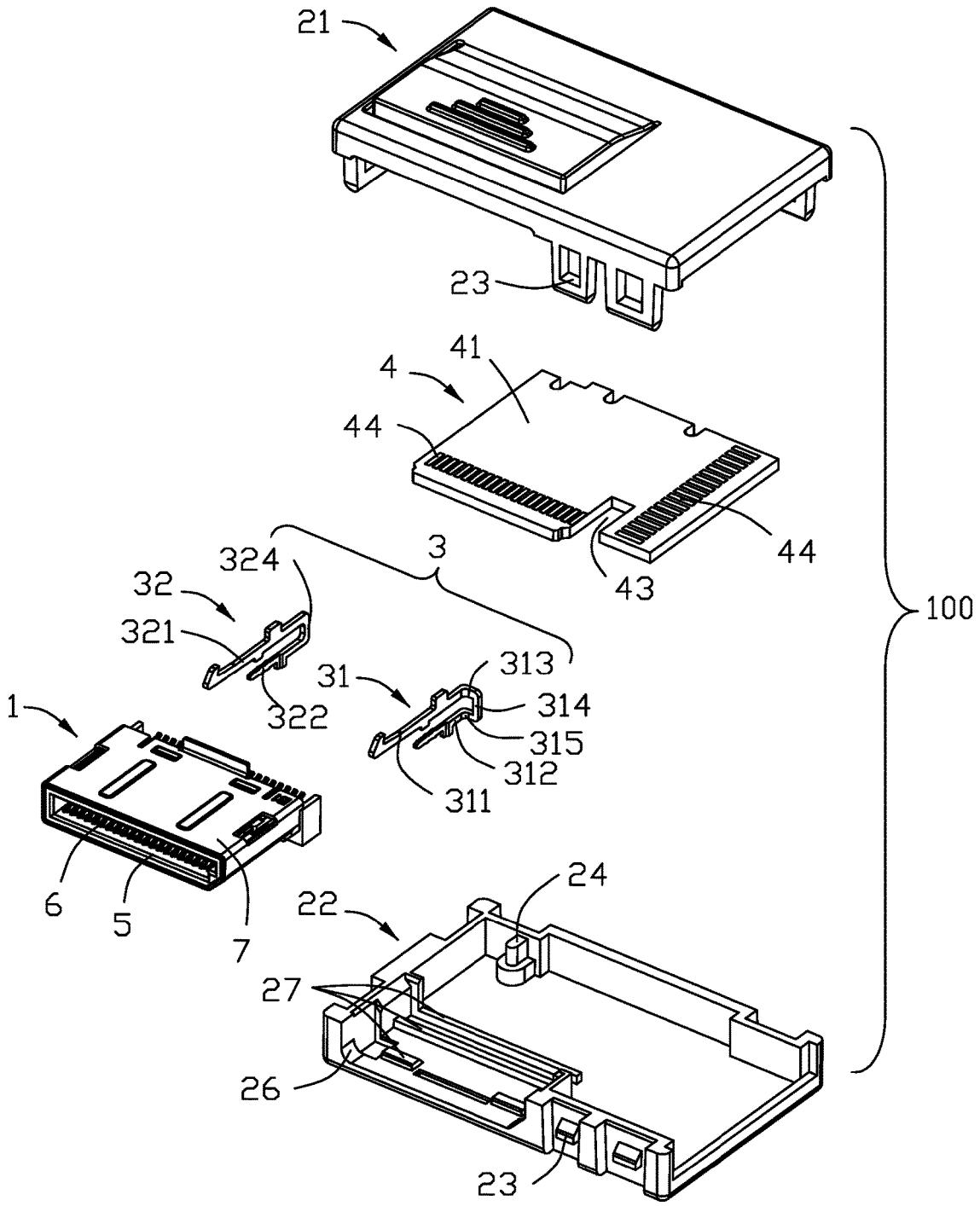
FIG. 4 is a partially exploded view showing the electrical connector shown in FIG. 1.
Figure 5:
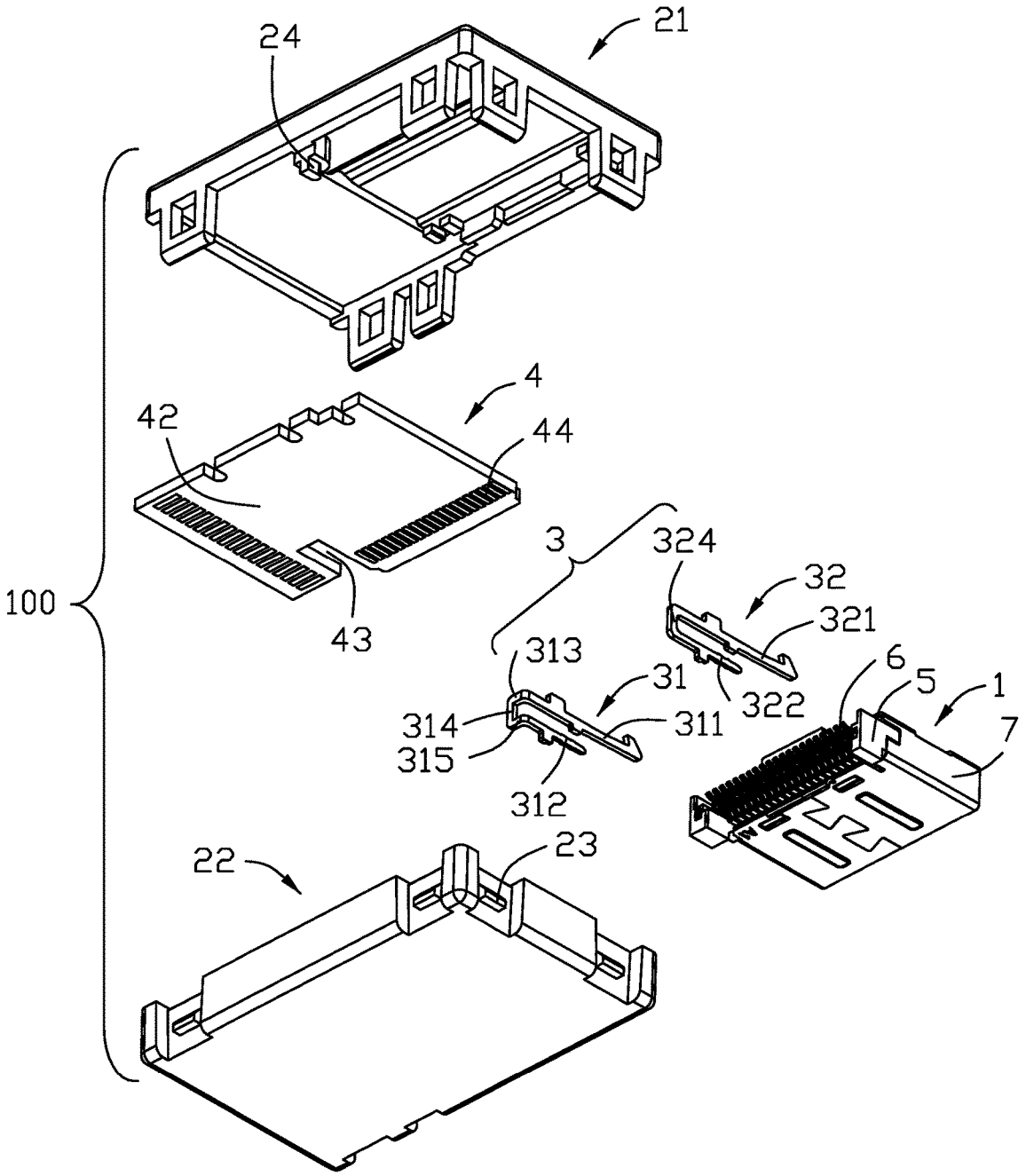
FIG. 5 is a partially exploded view similar to FIG. 4.

Reference will now be made to the drawing figures to describe a preferred embodiment of the present invention in detail.

Referring to FIGS. 1 to 5, the electrical connector assembly 100 according to the present invention, including an electrical connector 1, a latch member 3 received in the electrical connector 1, a printed circuit board 4 assembled on a rear end of the electrical connector 1 and an outer case 2 enclosing the electrical connector 1 and the printed circuit board 4.

Figure 6:
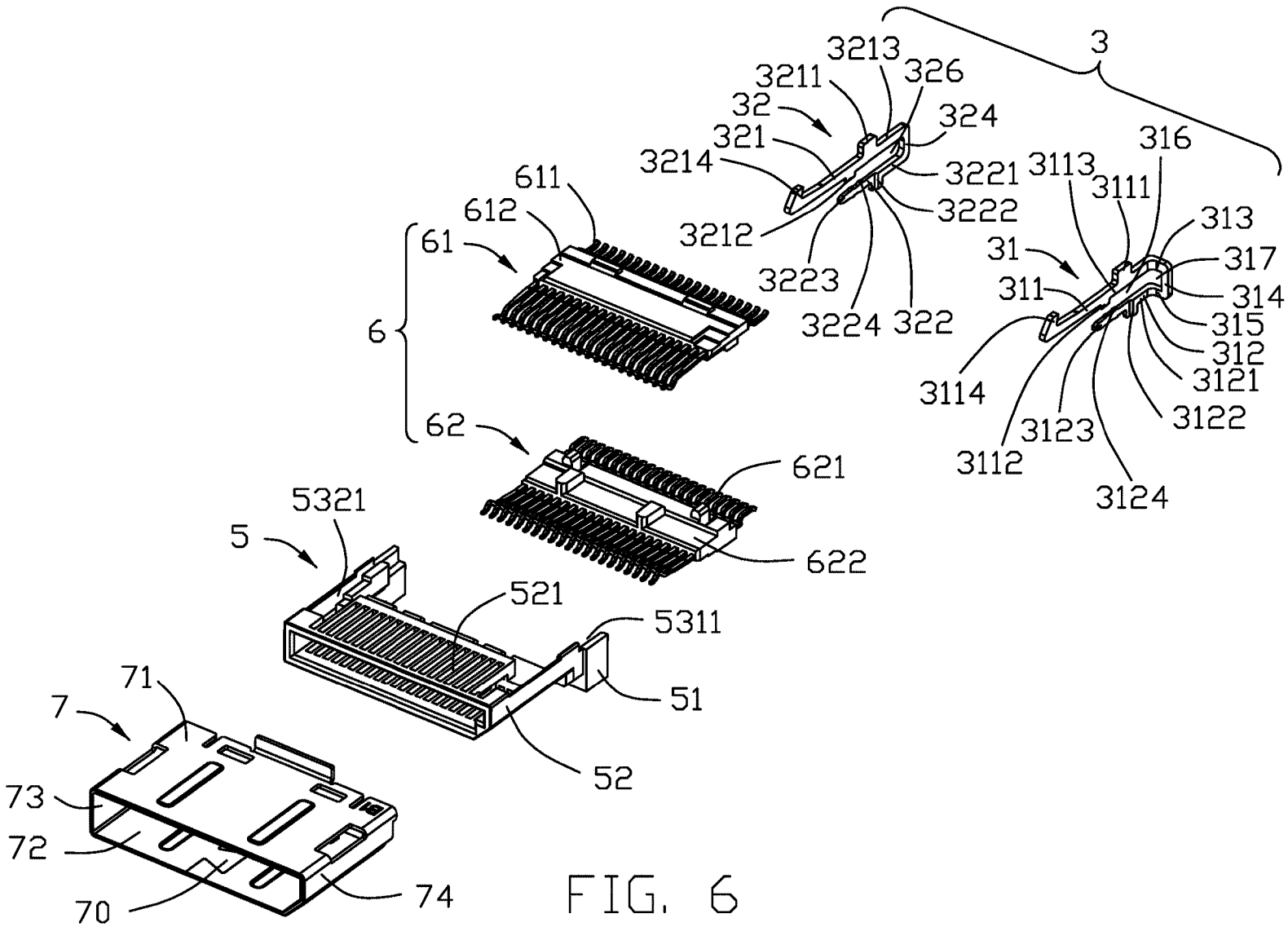
FIG. 6 is an exploded view showing the electrical connector and the latch member shown in FIG. 4.
Figure 7:
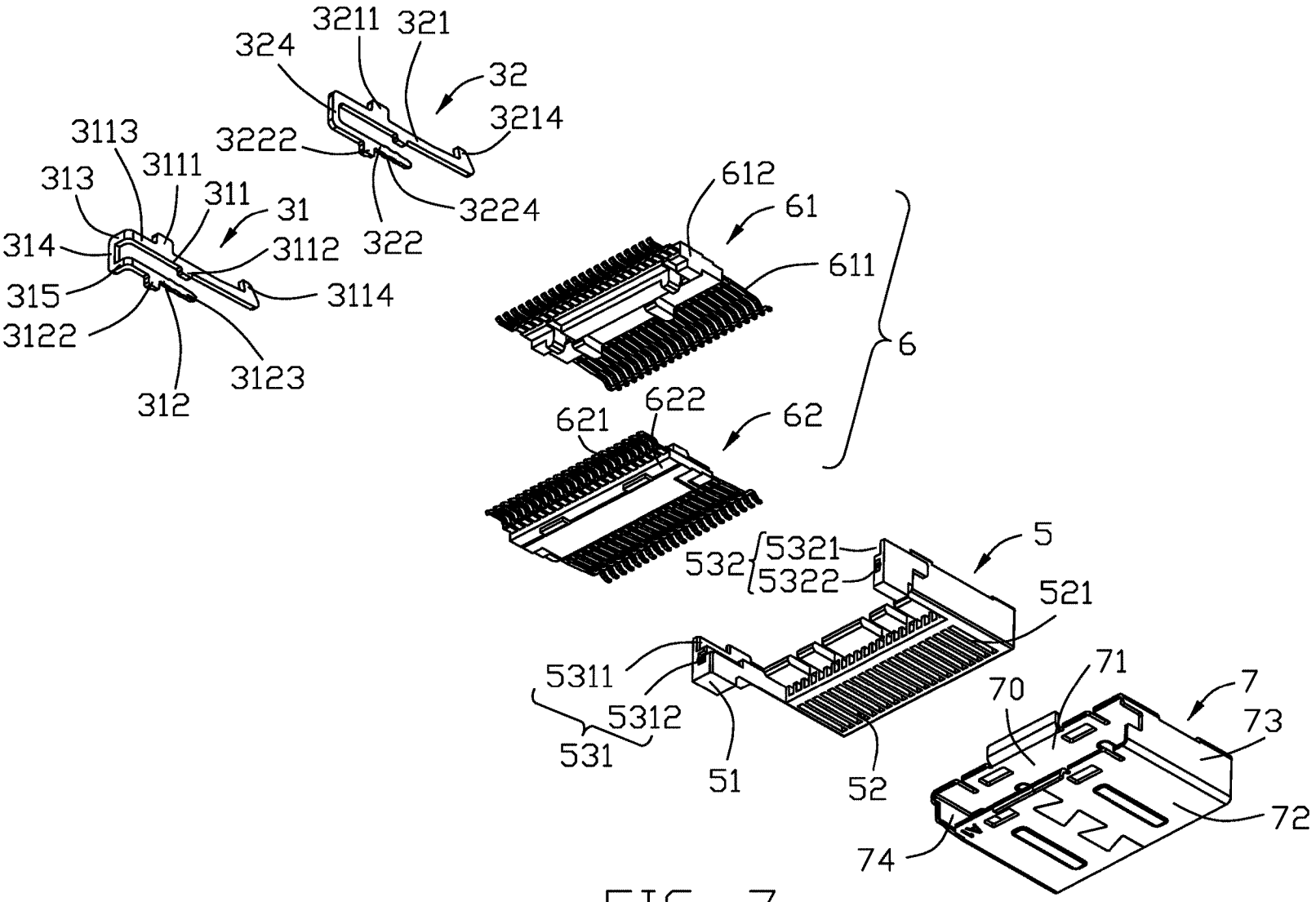
FIG. 7 is an exploded view similar to FIG. 6, but from a different perspective.

Referring to FIGS. 6 and 7, the electrical connector 1 includes an insulative housing 5, a contact module 6 received in the insulative housing 5 and a shielding case 7 enclosing the insulative 5. The contact module 6 includes a first terminal module 61 and a second terminal module 62. The first terminal module 61 includes a first insulative member 612 and a plurality of first contacts 611 received in the first insulative member 612. The second terminal module 62 includes a second insulative member 622 and a plurality of second contacts 621 received in the second insulative member 622. The first contacts 611 and the second contacts 621 are collectively referred to as contacts.

Referring to FIGS. 3-7, the latch member 3 includes a first latch 31 and a second latch 32. The first latch 31 includes a first latch arm 311 and a first fixing arm 312 stacked along a vertical direction, a first bent portion 313 bending from a rear end of the first latch arm 311, a second bent portion 315 bending from a rear end of the first fixing arm 312 and a connecting portion 314 connecting the first bent portion 313 and the second bent portion 315. The first latch arm 311 includes a first main body 3113, a first latch portion 3114 extending forward from the first main body 3113, a first pressing portion 3111 protruding upward from an upper surface of the first main body 3113 and a first limiting portion 3112 protruding downward from a bottom surface of the first main body 3113. The first fixing arm 312 includes a second main body 3121, a first guidance portion 3123 extending forward from the second main body 3121, a first stopping portion 3122 protruding downward from a bottom surface of the second main body 3121. The first guidance portion 3123 defines a plurality of barbs 3124 to strengthen the holding force with the insulating housing 5. In the present embodiment, the first latch arm 311 and the first fixing arm 312 are parallel to each other and define a first space 316 therebetween. The first bent portion 313 and the second bent portion 315 are parallel to each other and define a second space 317 therebetween. The extension direction of the first bent portion 313 is different from extension direction of the first latch arm 311. The extension direction of the second bent portion 315 is different from the extension direction of the first fixing arm 312. The extension direction of the first connecting portion 314 is different from the extension directions of the first bent portion 313 and the second bent portion 315. In the preferred embodiment, the extension direction of the first latch arm 311, the first bent portion 313 and the first connecting portion 314 are perpendicular to each other. The specific location relationships of the first fixing arm 312, the first bent portion 313, the second bent portion 315 and the first connecting portion 314 can be changed according to the actual situation.

Latch member 3 further includes a second latch 32, including a second latch arm 321, a second fixing arm 322 stacked along the vertical direction, a second connecting portion 324 connecting the second latch arm 321 and the second fixing arm 322. The second latch arm 321 includes a third main body 3213, a second pressing portion 3211 protruding upward from a top surface of the third main body 3212, a second limiting portion 3212 protruding downward from a bottom surface of the third main body 3212, a second latch portion 3214 extending forward from the third main body 3212. The second fixing arm 322 includes a fourth main body 3221, a second guidance 3223 extending forward from the fourth main body 3221 and a second stopping portion 3222 protruding from a bottom surface of the fourth main body 3221. The second guidance 3223 defines a plurality of barbs 3224 on the surfaces thereof. In the present embodiment, the second latch arm 321 and the second fixing arm 322 are parallel to each other and define a third space 326 therebetween. In other embodiment, the second latch arm 321, the specific locations relationship of the second fixing arm 322 and the connecting portion 324 of the second latch 32 can changed according to the actual situation.

Figure 8:
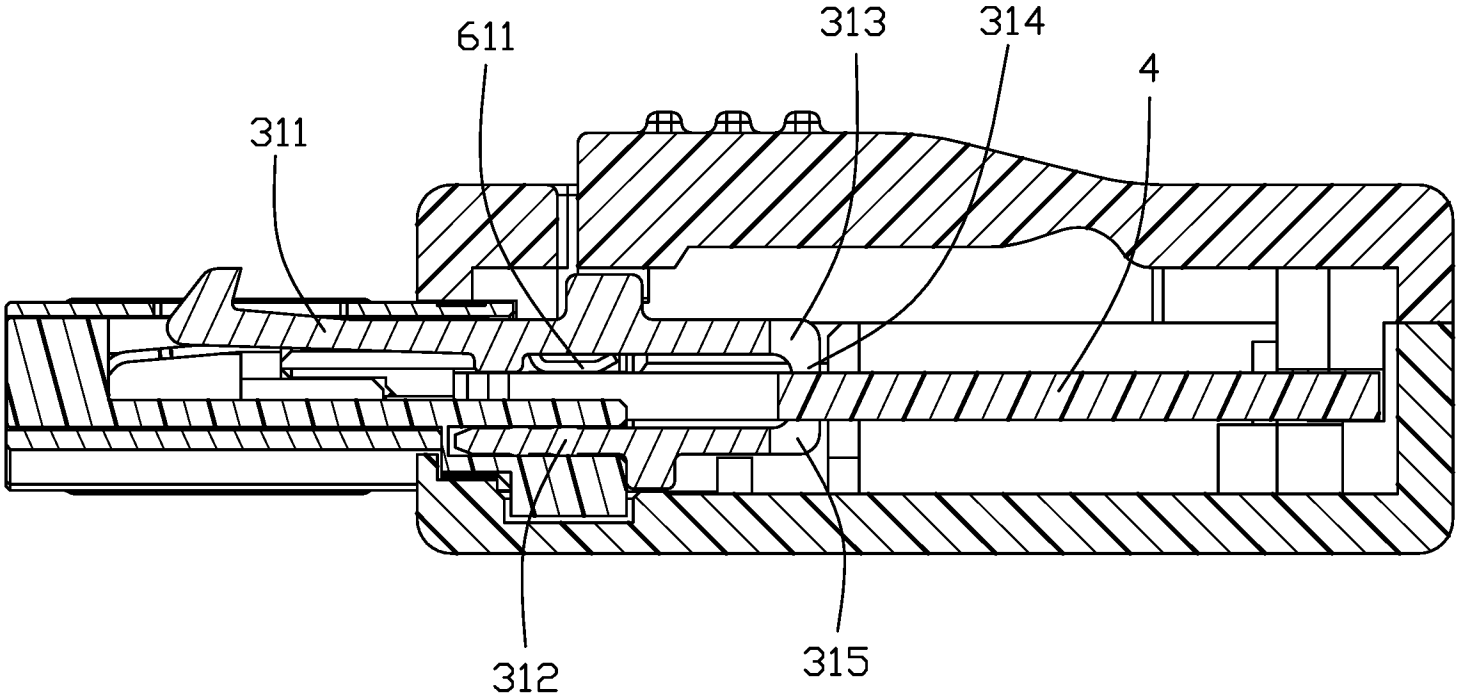
FIG. 8 is a cross-sectional view of the electrical connector assembly of FIG. 1.

Referring to FIGS. 6-8, the insulative housing 5 includes a base portion 51, a tongue portion 52 and a receiving room (not marked). The tongue portion 52 defines a plurality of contact slots 521 for receiving the contacts. The receiving room includes a first room 531 receiving the first latch 31 and a second room 532 receiving the second latch 32. The first room 531 includes a first slot 5311 for receiving the first latch arm 311 and a second slot 5312 for receiving the first fixing arm 312. The second room 532 includes a third slot 5321 for receiving the second latch arm 321 and a fourth slot 5322 for receiving the second fixing arm 322. Both of the top portions of first slot 5311 and the third slot 5321 are communicated with the outer side, so that the first latch portion 3114 and the second latch portion 3214 move along the vertical direction. The second slot 5312 and the fourth slot 5322 are formed by recessing from a rear surface of the base portion 51 respectively. Both of the stopping portion 3122 of the first latch 31 and stopping portion 3222 of the second latch 32 are stopped by the rear surface of the base portion 51 to prevent the latch member 3 from being excessively inserted into the insulating housing 5.

Referring to FIGS. 1 to 5, the shielding case 7 includes an upper case 71, a lower case 72, a left case 73, a right case 74 and a receiving room 70 surrounded by the upper case 71, the lower case 72, the left case 73 and the right case 74. The printed circuit board 4 includes a top surface 41, a bottom surface 42, a containment gap 43 recessing along a front-to-back direction and a plurality of conductive pads 44 exposed outside the top surface 41 and the bottom surface 42 for connecting to corresponding wires of the cable set (shown in dashed lines). The width of the containment gap 43 is smaller than the width of the first bent portion 313 and the second bent portion 315. In the prefer embodiment, a rear ne of the first latch 31 is stopped in the containment gap 43. The outer case 2 includes a top cover 21 and a bottom cover 22. A plurality of fastening structures 23 are formed on an edge area of the top cover and the bottom cover 22 to combine the top and bottom covers 21, 22 by a snap-fit method. A plurality of disposing posts 24 are formed between in the top and bottom cover 21, 22 to limit the position of the printed circuit board 4. An opening 26 is defined on the outer case 2 to allow the shielding case 7 to pass through. A plurality of limiting structure 27 are defined on the top and bottom cover 21, 22 to limit the position of the shielding case 7, the insulative housing 5 and the second latch 32.

During assembling, the contact module 6 is received in the insulative housing 5; the latch member 3 is received in the receiving room of the insulative housing 5, the first latch 31 received in the first room 531 and the second latch 32 received in the second room 532; the insulative housing 5 assembled with the contact module 6 and the latch member 3 is fixed in the shielding case 7; the printed circuit board 4 is assembled on a rear end of the insulative housing 5; the contacts is electrically connected with the corresponding conductive pads; a tail end of the first latch 31 is received in the containment gap 43 of the printed circuit board 4; the second latch 32 is disposed on a side of the printed circuit board 4; the outer case 2 is enclosed the outside of the printed circuit board 4 and the shielding case 7. In the present invention, on one hand, the first and second bent portions 313, 315 increases the length of the elastic arm of the first latch 31, and satisfies the elastic latching requirement of the first latch 3, on the other hand, the first and second bent portions 313, 315 reduces the length of the first latch 31, so that a shorter containment gap 43 on the printed circuit board 4 is need to receiving the first latch 31, to prevent the containment gap 43 from being too long and affecting the placement of other components on the printed circuit board 4. In the present embodiment, by combining the first latch 31 and the second latch 32 with different structures, the best space saving effect can be achieved while satisfying the product performance. In other embodiment, according to the actual situation, two latch members with a bending portion can be designed. The length of the bending portion can be designed according to the actual situation. Notably, in this embodiment, because the printed circuit board 4 is sandwiched between the first contacts 611 and the second contacts 621 in the vertical direction, the printed circuit board 4 is also located between the latch arm 311/321 and the fixing arm 312/322 in the vertical direction. In other words, the connecting portion 314 of the first latch 31 is essentially moveable in the corresponding containment gap 43. Another feature of the invention is to have fastening structures 23 formed on three sides of the outer case 2 while leaving an opening 29 in the fourth side for cable extension (shown in dashed lines) wherein the fastening structures 23 located on the same side with the connector 1, are adjacent to the opening 29 compared with the connector 1. In brief, in this embodiment, both the contacts and the latches are deflectable in the vertical direction while the connector is mateable in a first horizontal direction and the pair of latches are spaced from each other in a second horizontal direction perpendicular to the first horizontal direction. Understandably, as mentioned before, the bent portion 313, 315 intentionally increases the dimension of the containment gap 46 in the second direction so as to decrease that in the first direction, thus maximizing the usage of the printed circuit board 4.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. An electrical connector assembly comprising:

an outer case defining first and second opening on two adjacent sides thereof;

a printed circuit board disposed in the outer case and defining first and second edges thereof, and a containment gap formed on the first edge; and an electrical connector connected to the first edge of the printed circuit board and disposed around the first opening, said connector including an insulative housing equipped with upper and lower rows of deflectable contacts and a pair of deflectable latches wherein both the contacts and the latches are deflectable in a vertical direction while the electrical connector is mateable along a first direction perpendicular to said vertical direction, and the pair of latches are spaced from each other in a second direction perpendicular to both said vertical direction and said first direction; wherein the upper row of contacts and the lower row of contacts are respectively located on two opposite surfaces of the printed circuit board in the vertical direction; wherein each of said latches includes a fixing arm securing to the housing, a latch arm exposed to an exterior in the vertical direction, and a connecting portion linked between the fixing arm and the latch arm in the vertical direction, the connecting portion of one of said latches is moveable within the containment gap while the fixing arm and the latch arm of the same corresponding latch are located around said two opposite surfaces of the printed circuit board.

2. The electrical connector assembly as claimed in claim 1, further including a cable set connected to the second edge and extending through the second opening.

3. The electrical connector assembly as claimed in claim 2, wherein said outer case includes fastening structures beside the first opening and adjacent to the second opening.

4. The electrical connector assembly as claimed in claim 1, wherein said one of the latches having the connecting portion in the containment gap, further forms an upper bent portion and a lower bent portion, and the corresponding connecting portion is linked between the upper bent portion and the lower bent portion.

5. The electrical connector assembly as claimed in claim 4, wherein the upper bent portion and the lower bent portion extend in a direction similar to the second direction.

* * * * *